US009513589B2

(12) United States Patent
Arimura

(10) Patent No.: US 9,513,589 B2
(45) Date of Patent: Dec. 6, 2016

(54) SHEET DISCHARGE TRAY AND IMAGE FORMING APPARATUS

(71) Applicant: KYOCERA Document Solutions Inc., Osaka (JP)

(72) Inventor: Shingo Arimura, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/948,468

(22) Filed: Nov. 23, 2015

(65) Prior Publication Data

US 2016/0147189 A1 May 26, 2016

(30) Foreign Application Priority Data

Nov. 26, 2014 (JP) ..... 2014-238559

(51) Int. Cl.
*B65H 31/02* (2006.01)
*G03G 15/00* (2006.01)
*B65H 31/20* (2006.01)

(52) U.S. Cl.
CPC ..... *G03G 15/6552* (2013.01); *B65H 31/02* (2013.01); *B65H 31/20* (2013.01); *B65H 2220/01* (2013.01); *B65H 2301/4212* (2013.01); *B65H 2405/1124* (2013.01); *B65H 2405/11151* (2013.01); *B65H 2405/12* (2013.01); *B65H 2511/11* (2013.01); *B65H 2511/20* (2013.01); *B65H 2511/214* (2013.01)

(58) Field of Classification Search
CPC ... B65H 31/00; B65H 31/26; B65H 2405/111; B65H 2405/1111; B65H 2405/11151;B65H 2405/1116; B65H 2405/11161; B65H 2405/11162; B65H 2405/1117; B65H 31/02; G03G 15/6552
USPC ..... 271/207, 213
See application file for complete search history.

(56) References Cited

U.S. PATENT DOCUMENTS

| | | | | |
|---|---|---|---|---|
| 4,943,043 | A | 7/1990 | Huggins et al. | |
| 2009/0121414 | A1* | 5/2009 | Ito | B65H 31/02 271/209 |
| 2011/0074084 | A1* | 3/2011 | Shih | B65H 31/02 271/3.14 |
| 2011/0198801 | A1* | 8/2011 | Yamaguchi | B65H 31/02 271/207 |
| 2013/0307211 | A1 | 11/2013 | Morita | |
| 2014/0001702 | A1* | 1/2014 | Wu | B65H 31/00 271/207 |

(Continued)

FOREIGN PATENT DOCUMENTS

| | | |
|---|---|---|
| JP | 2001-348153 | 12/2001 |
| JP | 2002-284428 | 10/2002 |

(Continued)

*Primary Examiner* — David H Bollinger
(74) *Attorney, Agent, or Firm* — Wenderoth, Lind & Ponack, L.L.P.

(57) ABSTRACT

A support unit is provided at a downstream side of a tray surface tilted upward in a sheet discharge direction so as to be movable in the sheet discharge direction and a reverse direction of the sheet discharge direction. The support unit has a support plate that supports a discharge sheet from below. The support plate is tilted in a vertical direction by being supported at an upstream end of the support plate in as a fulcrum and is raised and downed with respect to the tray surface so as to change an angle.

12 Claims, 10 Drawing Sheets

(56) References Cited

U.S. PATENT DOCUMENTS

2014/0167349 A1* 6/2014 Niimura ..... B65H 31/22
271/213

FOREIGN PATENT DOCUMENTS

JP 2007-246281 9/2007
JP 2014-84187 5/2014

* cited by examiner

SHEET DISCHARGE TRAY AND IMAGE FORMING APPARATUS

CROSS-REFERENCE TO RELATED APPLICATION

This application is based upon and claims the benefit of priority from Japanese Patent Application No. 2014-238559 filed on Nov. 26, 2014, the entire contents of which are incorporated herein by reference.

BACKGROUND

The technology of the present disclosure relates to an image forming apparatus such as a copy machine and a printer and a sheet discharge tray that is a part of the image forming apparatus and stocks discharge sheets.

There has been proposed an image forming apparatus in which a support plate for supporting discharge sheets from below is provided midway in a sheet discharge direction of a tray surface of a sheet discharge tray so as to be swingably in a vertical direction. There is also a case in which the aforementioned support plate is called an inclined plane formation unit.

According to the aforementioned image forming apparatus, the inclination of the inclined plane formation unit is adjusted in response to the sheet sizes of the discharge sheets, so that it is possible to stock the discharge sheets in a state in which the discharge sheets have been aligned in the sheet discharge tray, regardless of the sheet sizes.

SUMMARY

A sheet discharge tray according to one aspect of the present disclosure is a sheet discharge tray that stocks sheets (discharge sheets) with a formed image thereon and discharged.

The aforementioned sheet discharge tray includes a tray surface. The tray surface is tilted upward in a sheet discharge direction. At a downstream side of the tray surface in the sheet discharge direction, a support unit having a support plate that supports the aforementioned discharge sheets from below is provided. The support unit is provided so as to be movable in the sheet discharge direction and a reverse direction of the sheet discharge direction. The aforementioned support plate is tilted in a vertical direction by being supported at an upstream end of the support plate in the sheet discharge direction as a fulcrum and is raised and downed with respect to the aforementioned tray surface so as to change an angle.

An image forming apparatus according to another aspect of the present disclosure is provided with the aforementioned sheet discharge tray.

DETAILED DESCRIPTION

Hereinafter, an example of an embodiment of the technology of the present disclosure will be described in detail on the basis of the drawings. In addition, the technology of the present disclosure is not limited to the following embodiment.

Figure 1:
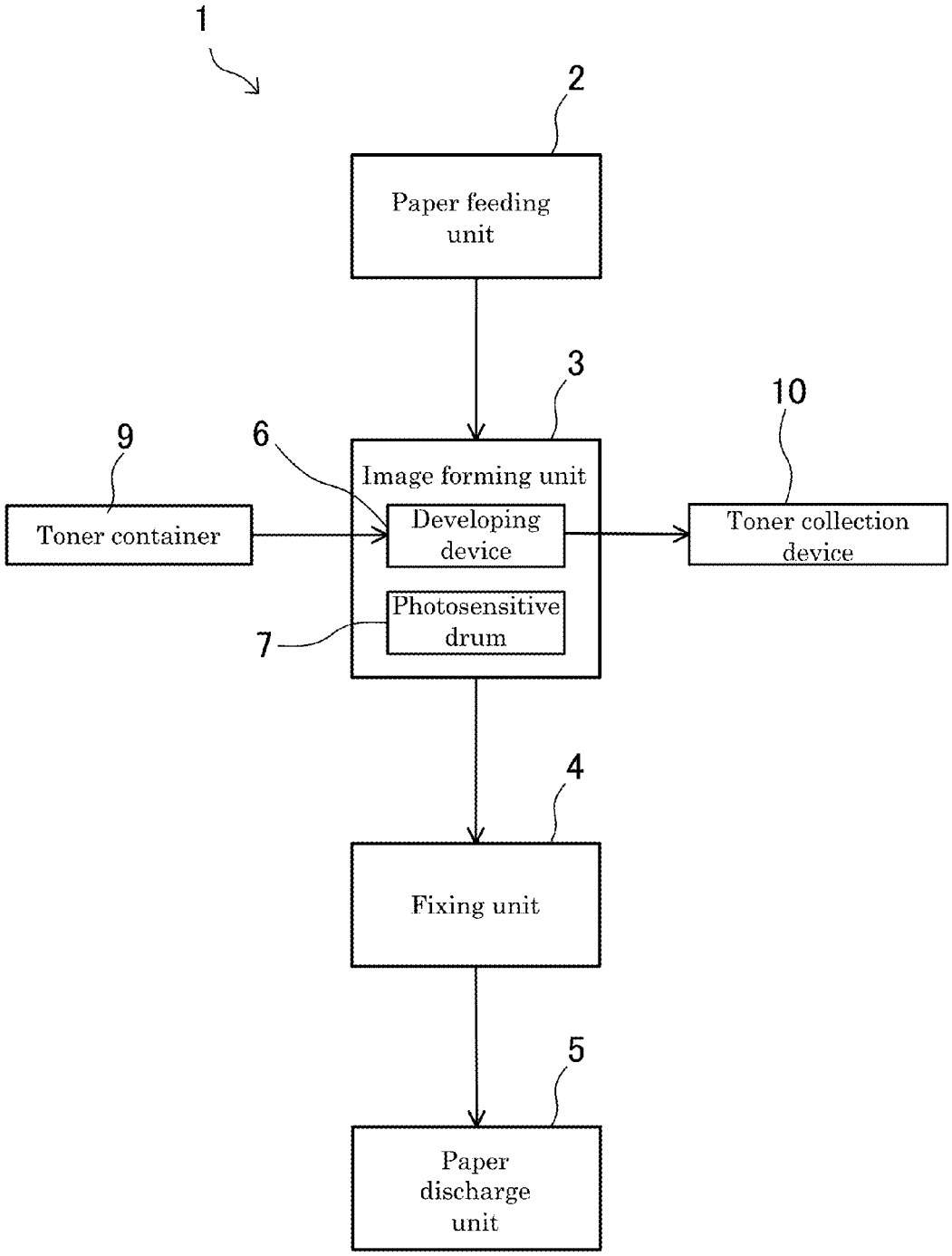
FIG. 1 is a block diagram illustrating a configuration of an image forming apparatus.

FIG. 1 illustrates an image forming apparatus 1 such as a laser printer and a multifunctional peripheral for example. The image forming apparatus 1 is configured to form an image on a sheet on the basis of image data transmitted from a terminal and the like (not illustrated) while conveying the sheet. The image forming apparatus 1 includes a sheet feeding unit 2, an image forming unit 3, a fixing unit 4, and a sheet discharge unit 5.

The sheet feeding unit 2 is a cassette sheet feeding unit or a manual tray which supplies sheets to the image forming unit 3. The image forming unit 3 includes a developing device 6, a photosensitive drum 7 and the like. In the image forming unit 3, an electrostatic latent image is formed on the photosensitive drum 7 by an optical scanning device (not illustrated). The electrostatic latent image formed on the photosensitive drum 7 is developed by the developing device and thus becomes a toner image. The toner image is transferred to a sheet supplied from the sheet feeding unit 2. The fixing unit 4 includes a fixing roller and a pressing roller (all are not illustrated). The fixing unit 4 fixes the toner image transferred to the sheet in the image forming unit 3 to the sheet. In this way, an image is formed on sheets. The sheet discharge unit 5 has a sheet discharge tray 8 (see FIG. 2). The sheets with the formed image are discharged from the fixing unit 4 to the sheet discharge tray 8. Hereinafter, the discharged sheets are called discharge sheets P (illustrated only in FIG. 7). The discharge sheets P are stacked in the sheet discharge tray 8 and are stocked.

Moreover, the image forming apparatus 1 includes a toner container 9 and a toner collection device 10. The toner container 9 accommodates a toner as a developer to be supplied to the developing device 6. The toner collection device 10 absorbs and collects toners scattered in the developing device 6.

Figure 2:
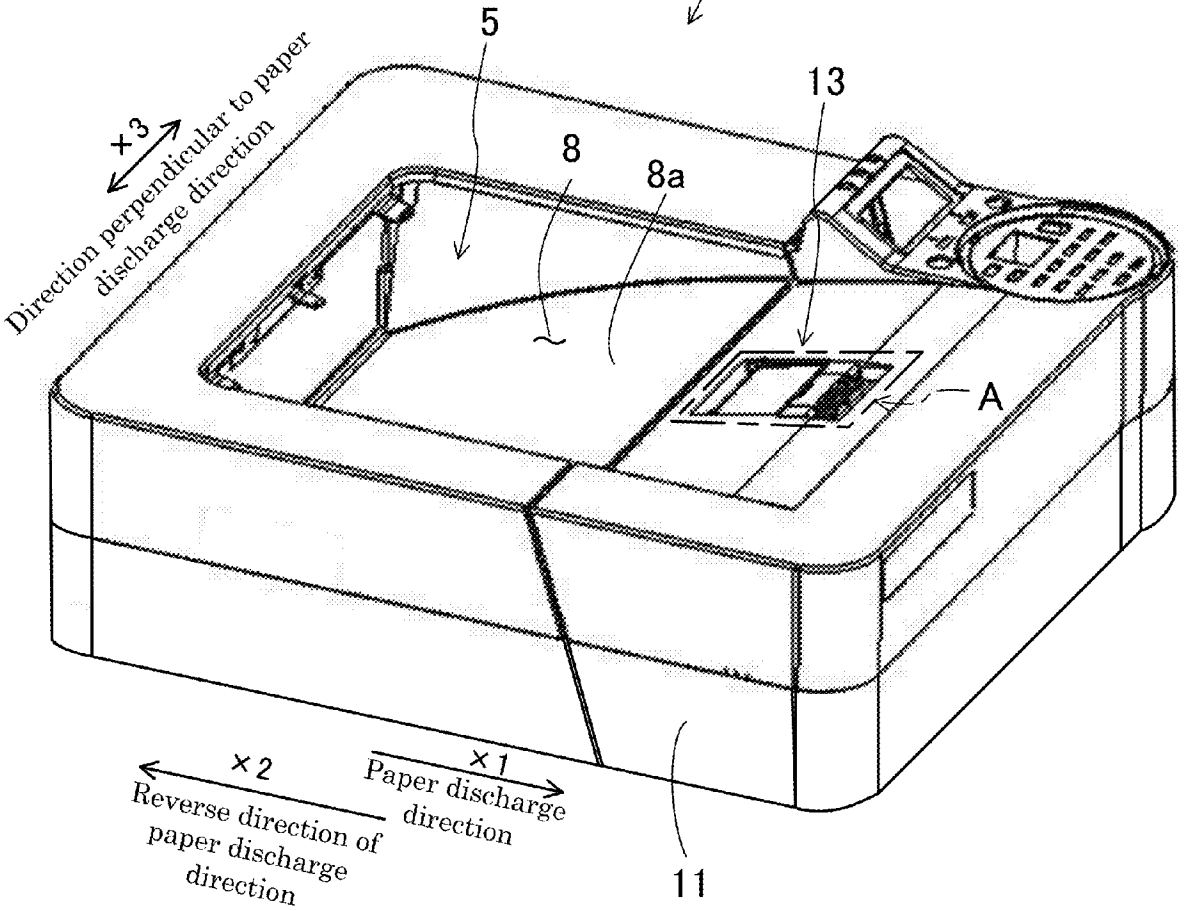
FIG. 2 is a diagram illustrating an external appearance of an image forming apparatus.

The sheet feeding unit 2, the image forming unit 3, and the fixing unit 4 are accommodated in a resinous outer case 11 illustrated in FIG. 2. The outer case 11 is provided on an upper surface thereof with the sheet discharge tray 8 so as to be recessed.

Figure 8:
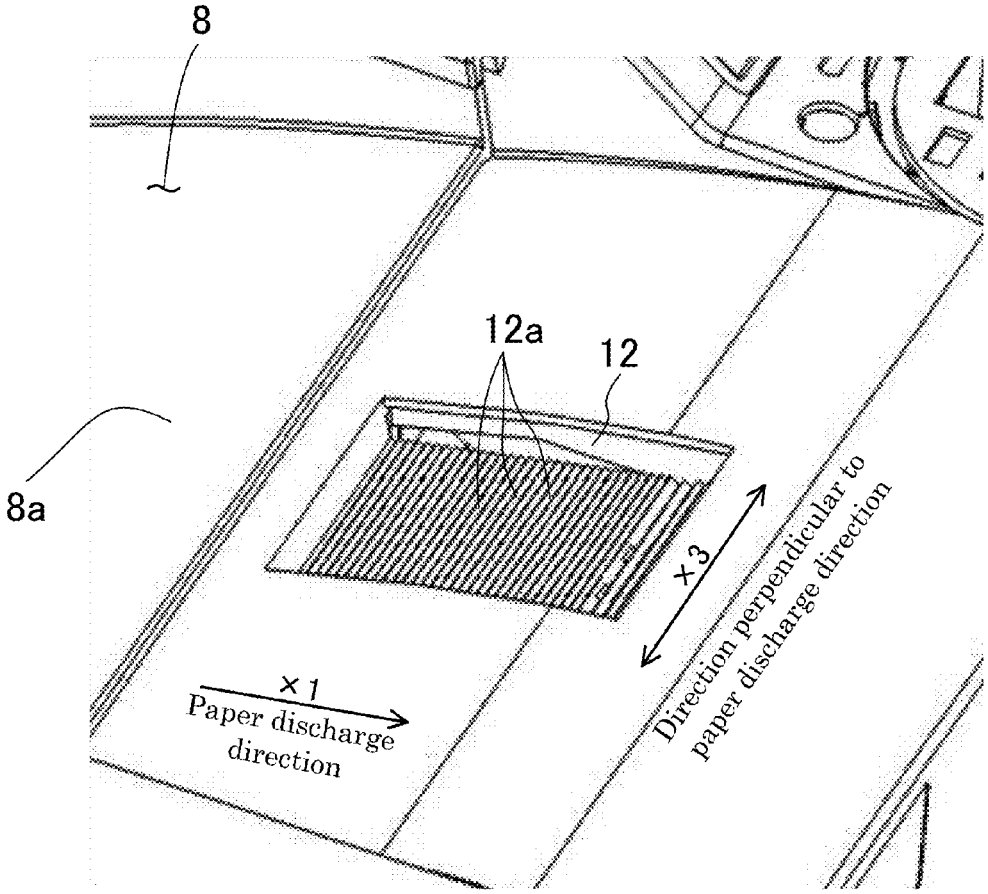
FIG. 8 is a perspective view of an accommodating recessed part.

The sheet discharge tray 8 has a tray surface 8*a* gently tilted upward in a sheet discharge direction X1 (the right direction of FIG. 2). At a downstream side (the right side of FIG. 2) of the tray surface 8*a* in the sheet discharge direction X1 and a middle part in a direction X3 (a sheet width direction) perpendicular to the sheet discharge direction X1, a rectangular accommodating recessed part 12 (an accommodating part) is formed as illustrated in FIG. 8. At a bottom surface of the accommodating recessed part 12, wave-like projections 12*a* are formed. The wave-like projections 12*a* extend in the direction X3 perpendicular to the sheet discharge direction X1. The wave-like projections 12*a* are configured by continuously forming a plurality of projecting parts along the sheet discharge direction X1.

Figure 9:
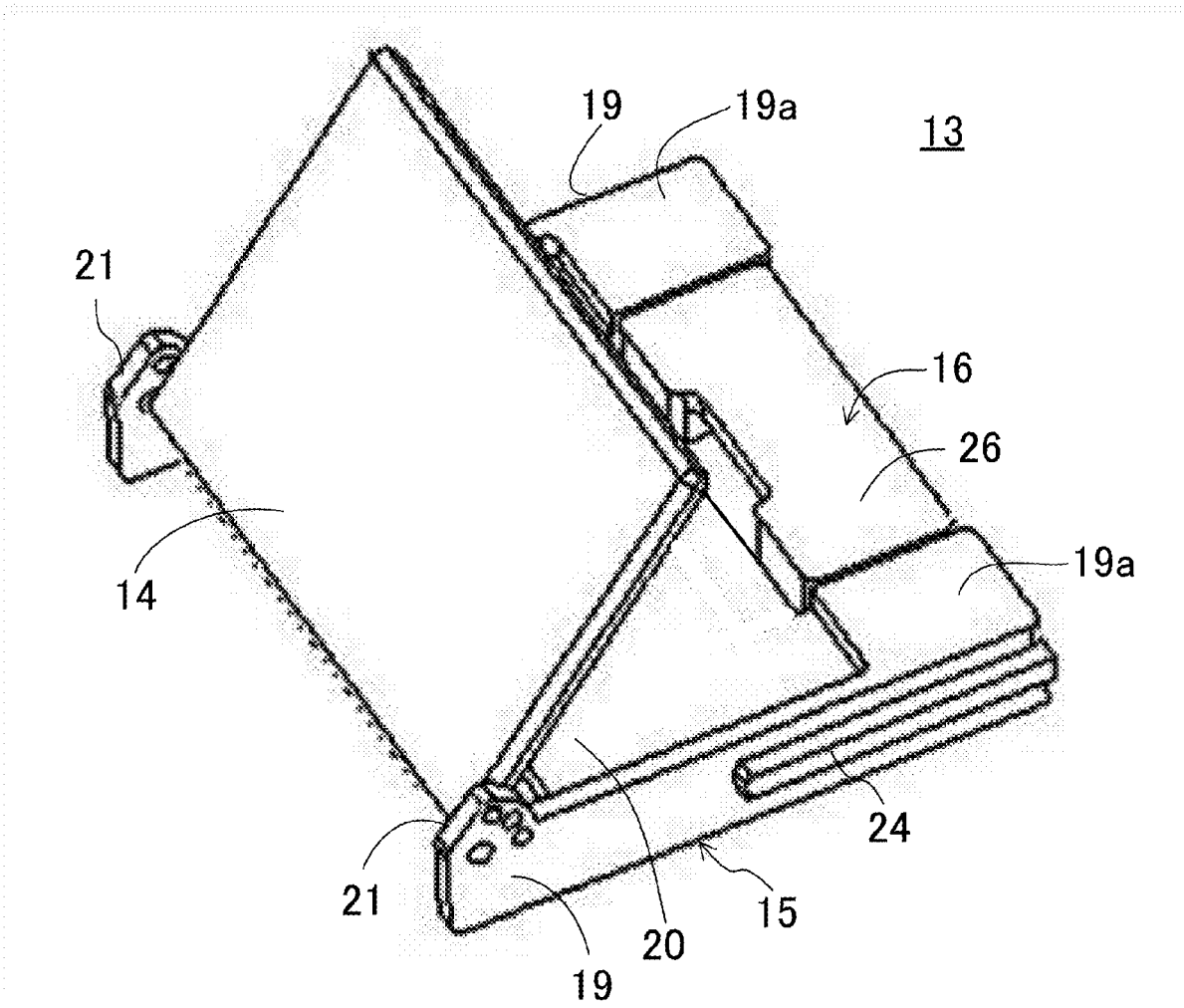
FIG. 9 is a perspective view of a support unit.

The accommodating recessed part 12 accommodates a support unit 13 as illustrated in the enlarged views of FIG. 3 to FIG. 7. The support unit 13 is configured with an assembly of three resinous products of a support plate 14, a holder 15, and a movement restriction member 16 as illustrated in FIG. 9.

Figure 10:
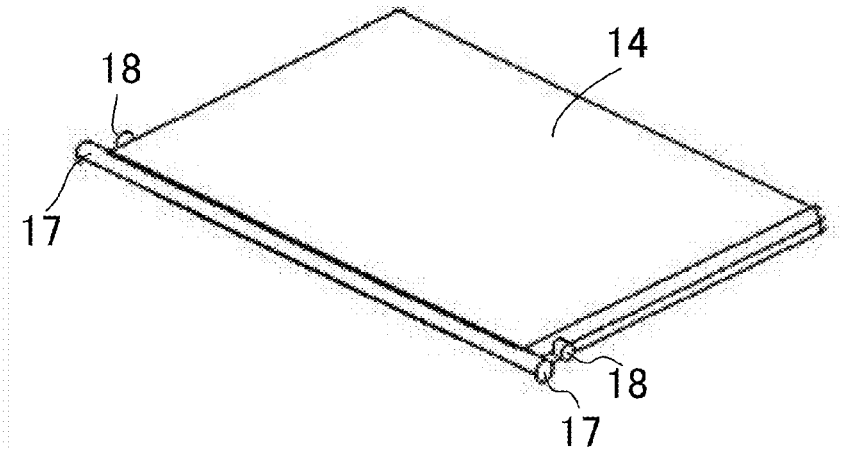
FIG. 10 is a perspective view of a support plate.

The support plate 14 is for supporting the discharge sheets P from below. As illustrated in FIG. 10, the support plate 14 is made of a rectangular plate material. At an end edge of an upstream side in the sheet discharge direction X1 between two both end edges extending in the direction X3 perpendicular to the sheet discharge direction X1, a support shaft 17 is integrally formed. Furthermore, at both end edges of the support plate 14 along the sheet discharge direction X1, angle adjustment bosses 18 integrally protrude adjacent to the support shaft 17.

Figure 11:
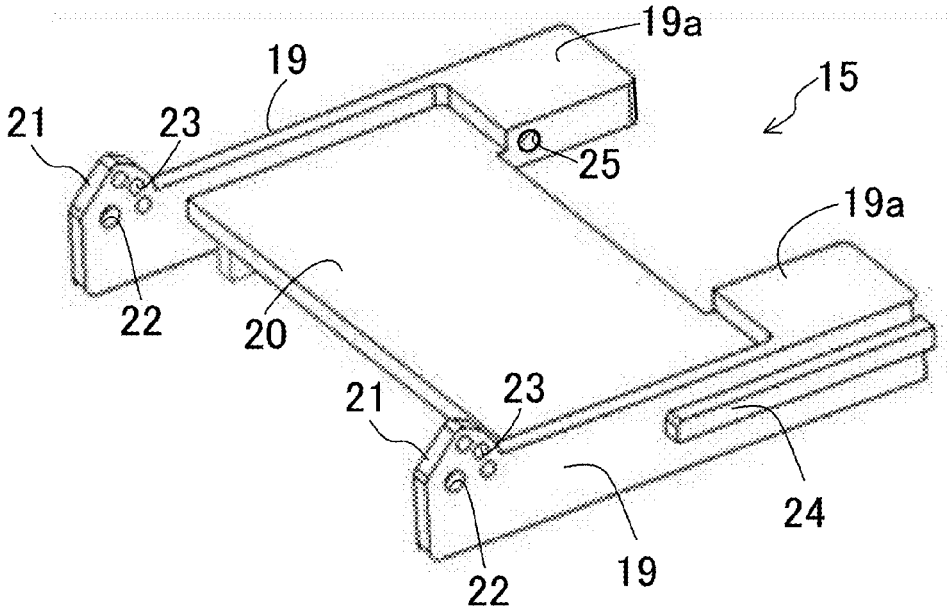
FIG. 11 is a perspective view of a holder.

As illustrated in FIG. 11, the holder 15 is configured by integrally connecting a pair of slide plates 19, which are spaced apart from each other in the direction X3 perpendicular to the sheet discharge direction X1, by a connection plate 20. At an end portion of an upstream side of each slide plate 19 in the sheet discharge direction X1, a swelling part 21 is integrally formed. The swelling part 21 projects upward from the end portion. In the range from the end portion of the upstream side of the slide plate 19 in the sheet discharge direction X1 to the swelling part 21, one support hole 22 and three angle adjustment holes 23 are formed.

Figure 13:
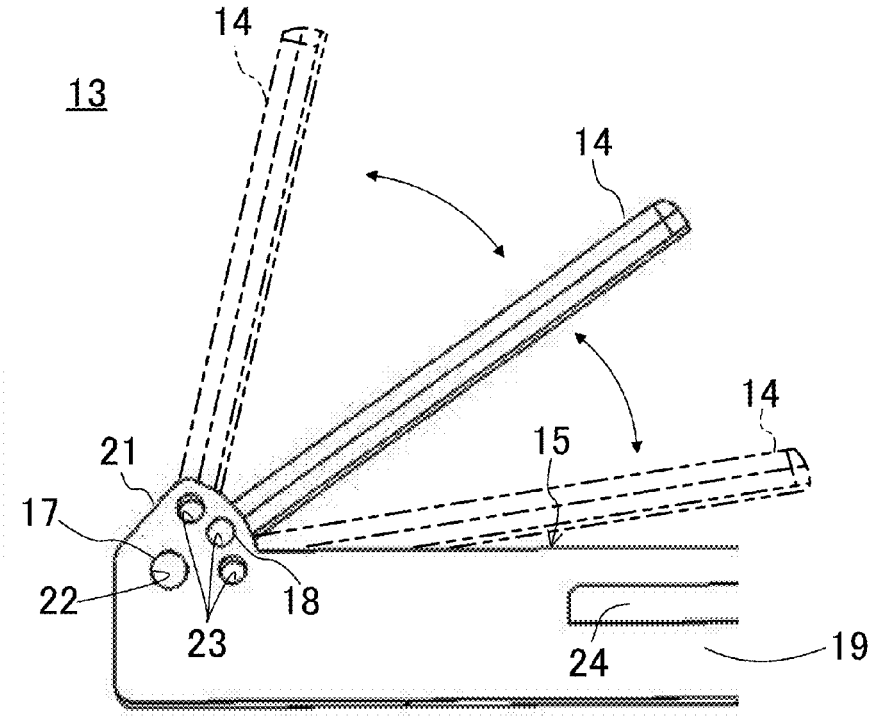
FIG. 13 is a side view in which a support plate has been assembled to a holder.

Furthermore, the support shaft 17 of the support plate 14 is fitted into the support holes 22 of the pair of slide plates 19 so as to be rotatable. In this way, an upstream end of the support plate 14 in the sheet discharge direction X1 is pivotally supported by the support holes 22 of the pair of slide plates 19. Consequently, the support plate 14 is pushed up and down with an end edge of a downstream side of the support plate 14 in the sheet discharge direction X1, so that the support plate 14 is tiltable in a vertical direction by being supported at the support shaft 17 as a fulcrum. At the time of the tilting, the adjustment bosses 18 are fitted into any of the three angle adjustment holes 23, so that the support plate 14 can be raised and downed at three stages of different angles with respect to the tray surface 8*a* (see FIG. 13). The adjustment bosses 18 are provided at front ends thereof with taper parts (not illustrated), so that fitting and removing operations for the angle adjustment holes 23 are smoothly performed.

Furthermore, from the middle of an outer surface of each slide plate 19 to an end portion of a downstream side of each slide plate 19 in the sheet discharge direction X1, a projecting part 24 for retaining and guiding is integrally formed. The projecting parts 24 are allowed to be engaged with recessed parts 29 (see FIG. 3) formed on surfaces opposing to each other of the accommodating recessed part 12 (the projecting parts 24 are allowed to be attached to two end edges extending in the sheet discharge direction X1 from below), so that the support unit 13 smoothly slides in the sheet discharge direction X1 and a reverse direction X2 of the sheet discharge direction in response to various sheet sizes of the discharge sheets P and thus the support unit 13 is stably received in the accommodating recessed part 12.

Moreover, at the end portion of the downstream side of an inner surface of each slide plate 19 in the sheet discharge direction X1, a mounting part 19*a* is integrally swellingly formed inward, and the mounting part 19*a* is formed at an inner surface thereof with a mounting hole 25 for mounting the movement restriction member 16.

Figure 12:
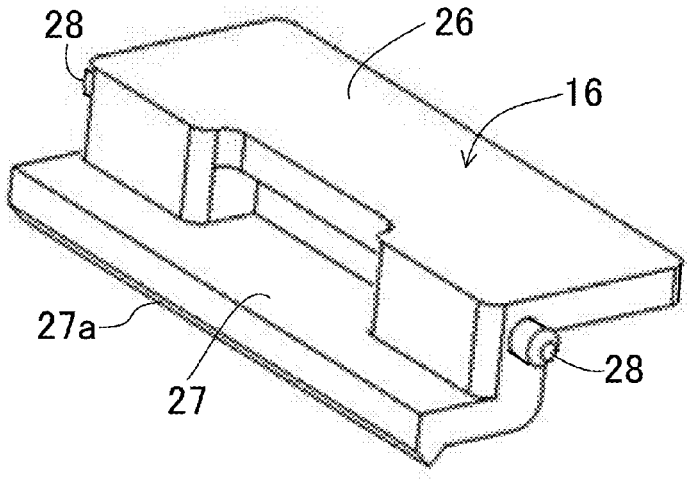
FIG. 12 is a perspective view of a movement restriction member.

As illustrated in FIG. 12, the movement restriction member 16 is configured by an upper plate part 26 for filling between the mounting parts 19*a* of the slide plates 19, and a lower plate part with an approximately L shape 27 integrally formed with the upper plate part 26 downward from an end edge of an upstream side of the upper plate part 26 in the sheet discharge direction X1.

At boundaries between the upper plate part 26 and the lower plate part 27 of the movement restriction member 16, mounting bosses 28 are formed to project. The mounting bosses 28 are fitted into the mounting holes 25 of the holder 15 (the slide plates 19), so that the movement restriction member 16 is mounted at the holder 15 so as to be rotatable. Furthermore, at a lower end edge of the lower plate part 27, an engaging claw 27*a* disengageably engaged with the wave-like projections 12*a* of the accommodating recessed part 12 is integrally formed.

Figure 7:
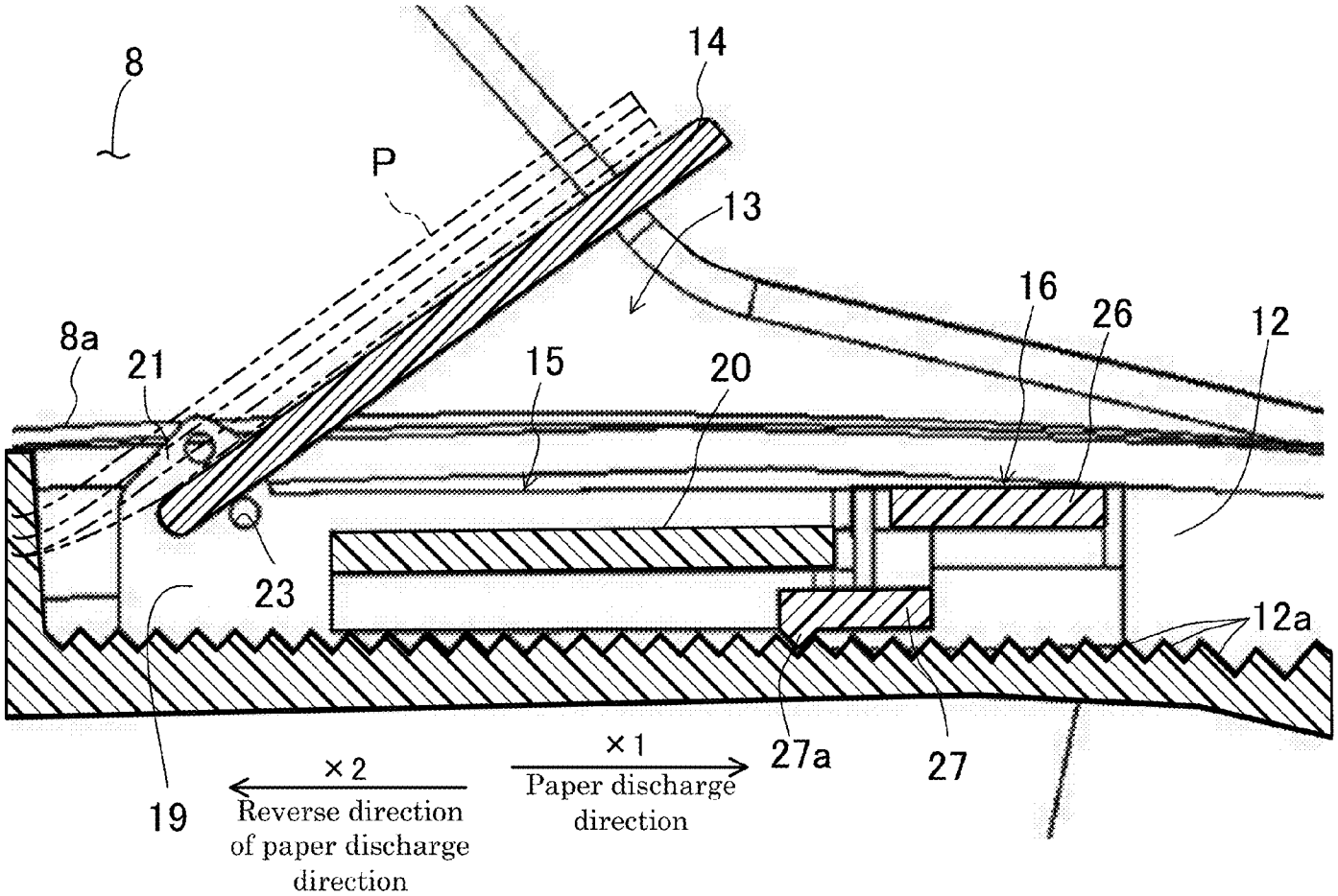
FIG. 7 is a sectional view taken along line VII-VII of FIG. 5.

Furthermore, an end edge of a downstream side of the upper plate part 26 of the movement restriction member 16 in the sheet discharge direction X1 is lifted upward to allow the engaging claw 27*a* to be engaged with the wave-like projections 12*a*, so that the movement of the holder 15 (the support unit 13) can be restricted at an arbitrary position in the sheet discharge direction X1 and the reverse direction X2 of the sheet discharge direction (see FIG. 7).

In the case of moving the holder 15 (the support unit 13), it is sufficient if the end edge of the downstream side of the upper plate part 26 in the sheet discharge direction X1 is pushed downward to allow the engaging claw 27*a* to be separated from the wave-like projections 12*a*, thereby pushing/pulling the holder 15 (the support unit 13) in the sheet discharge direction X1 and the reverse direction X2 of the sheet discharge direction.

Figure 3:
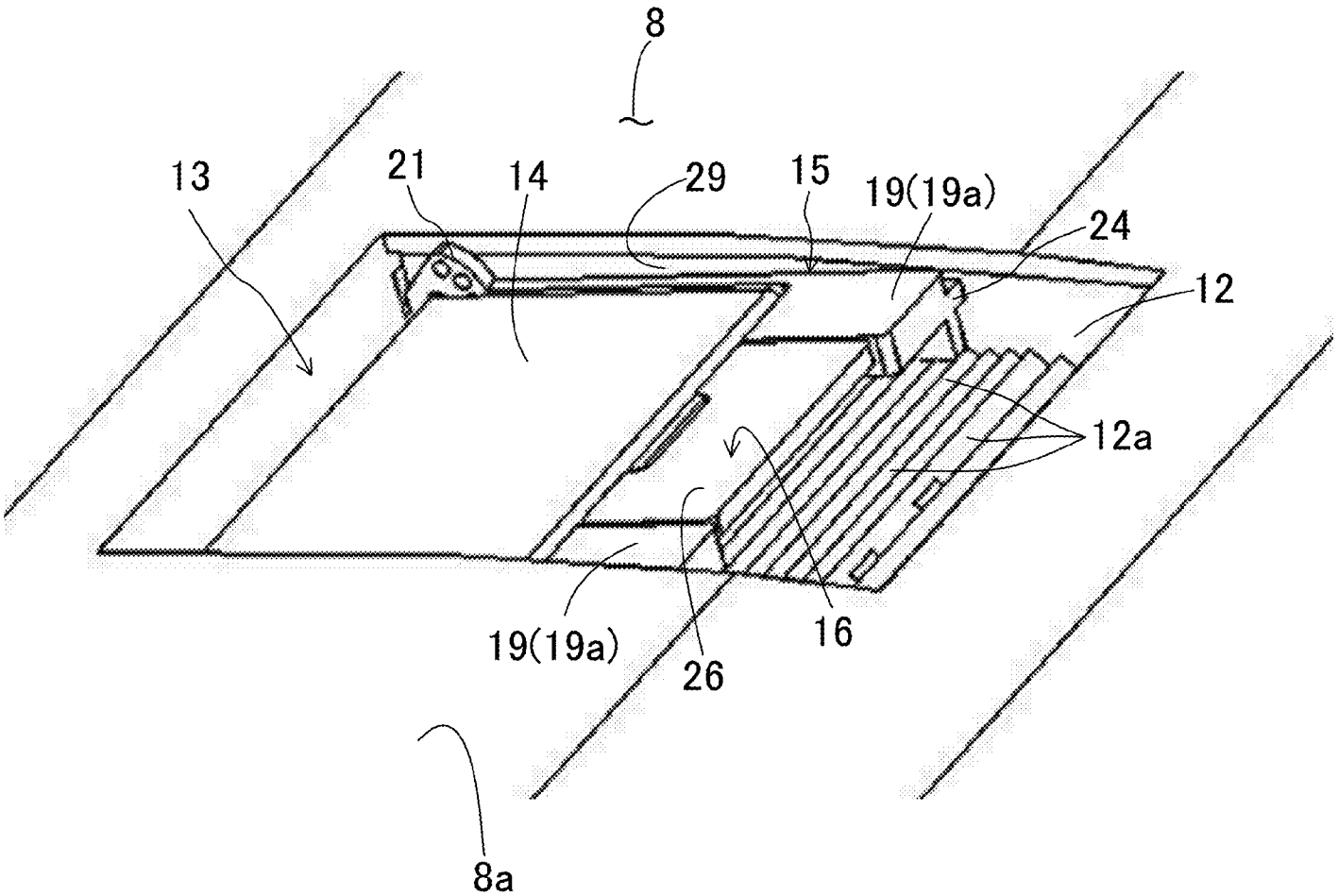
FIG. 3 is an enlarged view of a part A of FIG. 2.
Figure 4:
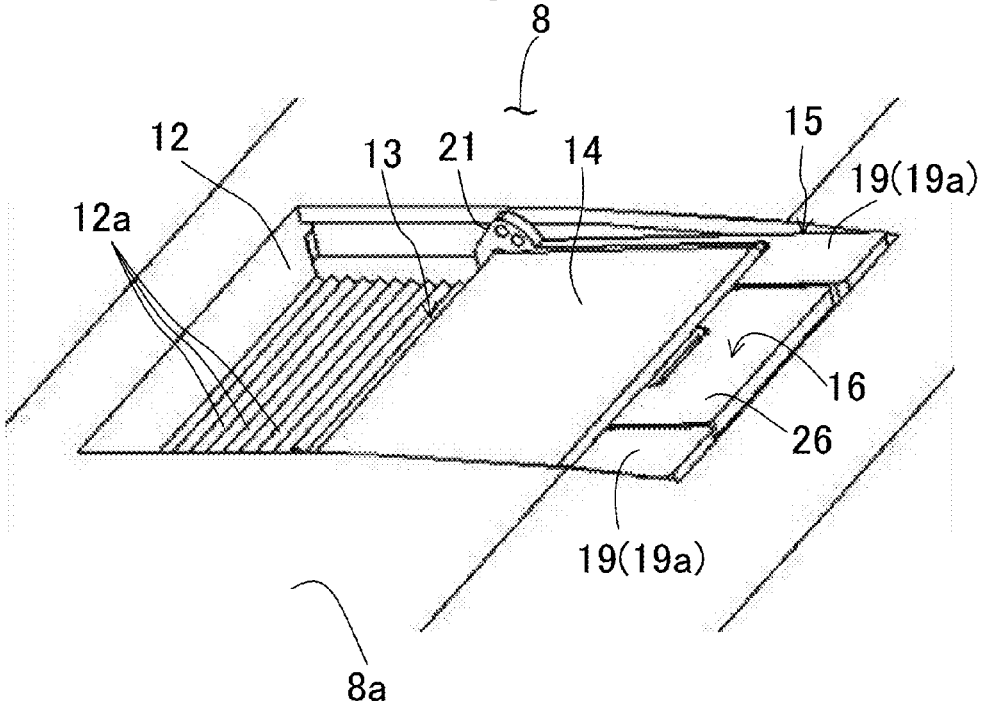
FIG. 4 is a diagram illustrating a state in which a support unit has been moved from the state of FIG. 3 to a downstream end of a sheet discharge direction.

For example, when the discharge sheet P has a maximum size, the holder 15 is pulled up to a downstream end of the accommodating recessed part 12 in the sheet discharge direction X1 to move the holder 15 (the support unit 13) from the position illustrated in FIG. 3 to the position illustrated in FIG. 4. When the discharge sheet P has a size smaller than the maximum size, the holder 15 is stopped midway in the sheet discharge direction X1. Alternatively, when the discharge sheet P has a minimum size, the holder 15 (the support unit 13) is allowed to be positioned at an upstream end of the accommodating recessed part 12 in the sheet discharge direction X1 as illustrated in FIG. 3. In this state, the support plate 14 is pushed up or down in response to sheet sizes and the adjustment bosses 18 are fitted into any of the three angle adjustment holes 23, so that the support plate 14 is tilted with respect to the tray surface 8*a* at an appropriate angle.

Figure 5:
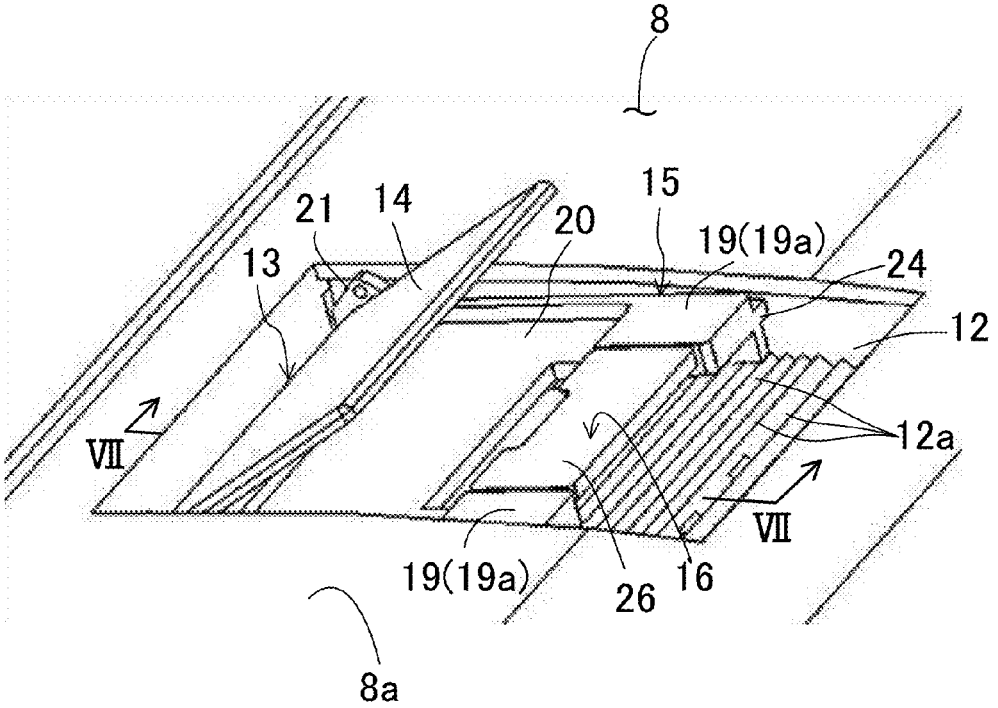
FIG. 5 is a diagram illustrating a state in which a support plate has been obliquely raised upward from the state of FIG. 3.
Figure 6:
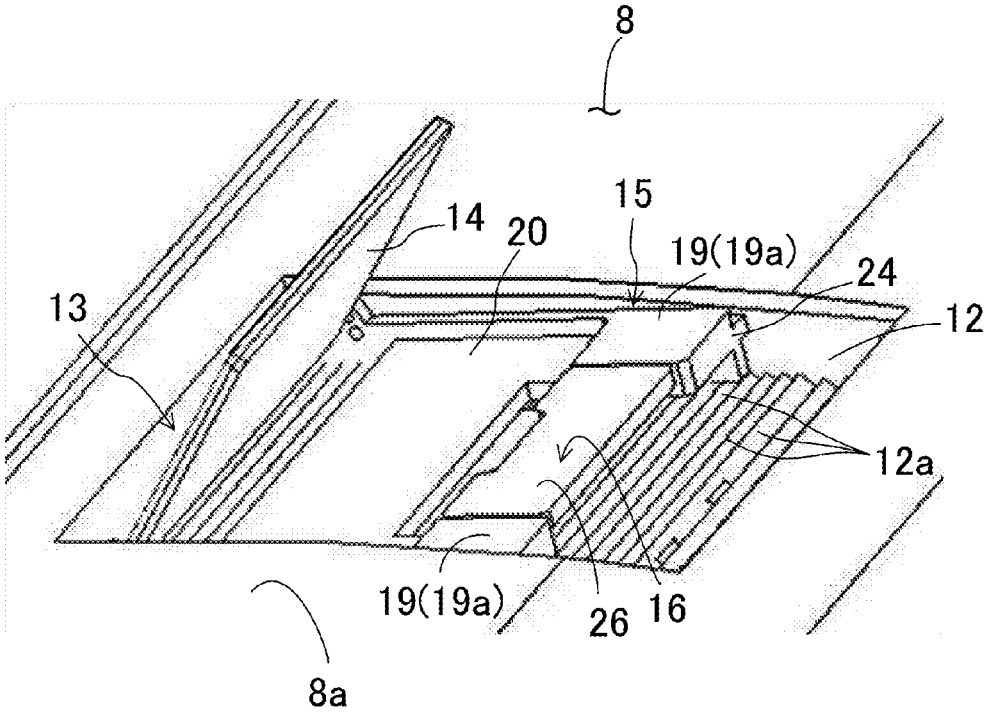
FIG. 6 is a diagram illustrating a state in which a support plate has been obliquely raised more upward from the state of FIG. 5.

As an example in which the tilt angle of the support plate 14 has been changed, three modes when the support unit has been positioned at the upstream end of the accommodating recessed part 12 in the sheet discharge direction X1 are illustrated in FIG. 3, FIG. 5, and FIG. 6. FIG. 3 illustrates the state in which the adjustment bosses 18 are fitted into the lowermost angle adjustment holes 23, so that the support plate 14 is laid, FIG. 5 illustrates the state in which the adjustment bosses 18 are fitted into the middle angle adjustment holes 23, so that the support plate 14 is raised at an about 40°, and FIG. 6 illustrates the state in which the adjustment bosses 18 are fitted into the uppermost angle adjustment holes 23, so that the support plate 14 is raised at an about 90°.

As described above, in the sheet discharge tray 8 of the embodiment, not only the tilt angle of the support plate 14 is changed and but also the support unit 13 is moved in the sheet discharge direction X1 and the reverse direction X2 of the sheet discharge direction, so that the position of the support plate 14 in the sheet discharge direction X1 is changed. In this way, the discharge sheets P with various sheet sizes can be reliably stocked in the sheet discharge tray 8 in an aligned state. Consequently, it is possible to prevent the discharge sheets P from falling from the sheet discharge tray 8 and prevent change of order from occurring. Consequently, it is possible to prevent deterioration of take-out properties of the discharge sheets P, JAM of curled sheets, and the like without allowing the tray surface 8*a* to be steep more than necessary.

Furthermore, the movement of the holder 15 is restricted by the movement restriction member 16 at an arbitrary position in the sheet discharge direction X1 and the reverse direction X2 of the sheet discharge direction, so that it is possible to prevent the support unit 13 from unexpectedly moving and thus it is possible to stably stock the discharge sheets P. In other words, it is possible to enhance the stock properties of the discharge sheets P.

Moreover, the engaging claw 27*a* of the movement restriction member 16 is allowed to be disengageably engaged with the wave-like projections 12*a* of the tray surface 8*a*, so that it is possible to simply and quickly perform the positioning of the support unit 13, that is, the support plate 14 at an arbitrary position in the sheet discharge direction X1 and the reverse direction X2 of the sheet discharge direction.

Consequently, such a sheet discharge tray 8 is provided, so that it is possible to stock the discharge sheets P at an appropriate position of the sheet discharge tray 8 in an aligned state regardless of sheet sizes, thereby improving usability of the image forming apparatus 1.

In addition, in the embodiment, the tilt angle of the support plate 14 is switched in three stages, but may be switched more than three stages by increasing the angle adjustment holes 23. Furthermore, any methods may also be employed as long as they can hold the support plate 14 at a predetermined tilt angle. That is, the technology of the present disclosure is not limited to the method, in which the adjustment bosses 18 are fitted into the middle angle adjustment holes 23, which are disclosed in the aforementioned embodiment.

Moreover, as long as the method can regulate the movement of the support unit 13 at an arbitrary position in the sheet discharge direction X1 and the reverse direction X2 of the sheet discharge direction, the method is not limited to the method in which the engaging claw 27*a* of the movement restriction member 16 is allowed to be disengageably engaged with the wave-like projections 12*a* of the tray surface 8*a*.

What is claimed is:

1. A sheet discharge tray that stocks a discharged sheet with an image formed thereon, the sheet discharge tray comprising:

a tray surface tilted upward in a sheet discharge direction;

an accommodating part provided at a downstream side of the tray surface in the sheet discharge direction; and a support unit provided to the accommodating part so as to be movable in the sheet discharge direction and a reverse direction of the sheet discharge direction and having a support plate that supports the discharged sheet from below, wherein the support plate is supported at an upstream end thereof in the sheet discharge direction as a fulcrum so as to swing in a vertical direction and is raised and lowered with respect to the tray surface so as to change an angle, and wherein the support unit includes:

a holder provided to the accommodating part so as to be movable in the sheet discharge direction and the reverse direction of the sheet discharge direction and pivotally supporting the upstream end of the support plate in the sheet discharge direction; and a movement restriction member that restricts movement of the holder at an arbitrary position in the sheet discharge direction and the reverse direction of the sheet discharge direction with respect to the accommodating part.

2. The sheet discharge tray of claim 1, wherein the accommodating part is formed with wave-like projections continuously formed along the sheet discharge direction and extending in a direction perpendicular to the sheet discharge direction, and the movement restriction member is formed with an engaging claw disengageably engaged with the wave-like projections.

3. The sheet discharge tray of claim 2, wherein the movement restriction member includes an upper plate part, a lower plate part with an approximately L shape integrally formed with the upper plate part downward from an end edge of an upstream side of the upper plate part in the sheet discharge direction, and mounting bosses projected at boundaries between the upper plate part and the lower plate part, and the holder includes mounting holes, into which the mounting bosses are fitted, which support the movement restriction member so as to be rotatable.

4. The sheet discharge tray of claim 3, wherein the engaging claw is provided at a lower end portion of the lower plate part.

5. An image forming apparatus comprising the sheet discharge tray of claim 4.

6. An image forming apparatus comprising the sheet discharge tray of claim 3.

7. An image forming apparatus comprising the sheet discharge tray of claim 2.

8. An image forming apparatus comprising the sheet discharge tray of claim 1.

9. A sheet discharge tray that stocks a discharged sheet with an image formed thereon, the sheet discharge tray comprising:

a tray surface tilted upward in a sheet discharge direction;

an accommodating part provided at a downstream side of the tray surface in the sheet discharge direction; and a support unit provided to the accommodating part so as to be movable in the sheet discharge direction and a reverse direction of the sheet discharge direction and having a support plate that supports the discharged sheet from below, wherein the support plate is supported at an upstream end thereof in the sheet discharge direction as a fulcrum so as to swing in a vertical direction and is raised and lowered with respect to the tray surface so as to change an angle, wherein the support plate includes a pair of support shafts projected at both end portions of an upstream side in the sheet discharge direction and a pair of angle adjustment bosses respectively projected adjacent to the support shafts, wherein the support unit includes a holder having a pair of slide plates extending along the sheet discharge direction in parallel to each other, wherein at an end portion of an upstream side of each of the slide plates in the sheet discharge direction, one support hole and a plurality of angle adjustment holes are formed along a circular arc centered at the support hole, and wherein the pair of support shafts are respectively fitted into the support holes, so that the support plate is swingably supported in a vertical direction, and the angle adjustment bosses are respectively fitted into any one of the plurality of angle adjustment holes, so that the support plate is fixed at a predetermined angle.

10. The sheet discharge tray of claim 9, wherein at the pair of slide plates, respective projecting parts for retaining and guiding are integrally formed, and the projecting parts are respectively engaged with recessed parts formed in opposing sides of the accommodating part, so that the support unit is configured to be slidably moved in the sheet discharge direction and the reverse direction of the sheet discharge direction.

11. An image forming apparatus comprising the sheet discharge tray of claim 10.

12. An image forming apparatus comprising the sheet discharge tray of claim 9.

* * * * *